US007284735B1

(12) United States Patent
Khosropour et al.

(10) Patent No.: US 7,284,735 B1
(45) Date of Patent: Oct. 23, 2007

(54) APPARATUS FOR HOLDING READING MATERIAL, BEVERAGE CONTAINERS OR OTHER ARTICLES EMPLOYED BY A BATHER

(75) Inventors: M. Michael Khosropour, Madison, WI (US); Jim R. Pauls, Concord, CA (US); Wayne J. Rosten, Antioch, CA (US)

(73) Assignee: Jacuzzi, Inc., West Palm Beach, FL (US)

( * ) Notice: Subject to any disclaimer, the term of this patent is extended or adjusted under 35 U.S.C. 154(b) by 201 days.

(21) Appl. No.: 10/952,255

(22) Filed: Sep. 28, 2004

Related U.S. Application Data

(60) Provisional application No. 60/535,877, filed on Jan. 12, 2004.

(51) Int. Cl.
*A47B 96/00* (2006.01)

(52) U.S. Cl. ..... 248/226.11; 248/205.5; 108/47; 220/483

(58) Field of Classification Search ..... 248/457, 248/227.2, 226.11, 229, 447.2, 447, 441.1, 248/445, 448, 444, 458, 205.5, 231.41; 108/47, 108/49, 46; 224/482, 585, 584; 5/3, 507.1; 220/483, 482, 481, 480
See application file for complete search history.

(56) References Cited

U.S. PATENT DOCUMENTS

| | | | | |
|---|---|---|---|---|
| 994,797 | A * | 6/1911 | Streit | 248/457 |
| 1,137,753 | A * | 5/1915 | Gottesman | 108/49 |
| 2,016,970 | A * | 10/1935 | Nussbaum | 108/46 |
| 2,267,861 | A * | 12/1941 | Haley | 297/163 |
| 2,558,911 | A * | 7/1951 | Penn | 248/205.6 |
| 3,834,782 | A * | 9/1974 | Pampinella | 312/248 |
| 4,575,149 | A * | 3/1986 | Forestal et al. | 297/145 |
| 5,259,581 | A * | 11/1993 | Goldberg | 248/444.1 |
| 5,295,650 | A * | 3/1994 | Brandt | 248/311.2 |
| 5,621,927 | A | 4/1997 | Reiss et al. | |
| 5,707,026 | A | 1/1998 | Lefebvre et al. | |
| 5,707,036 | A * | 1/1998 | Dunbar | 248/447.2 |
| 5,761,753 | A | 6/1998 | Talbert | |
| 6,257,535 | B1 * | 7/2001 | Jaing | 248/205.5 |
| 6,474,244 | B1 | 11/2002 | Karpinski | |
| 2002/0020797 | A1 | 2/2002 | Artz | |
| 2004/0034914 | A1 | 2/2004 | Gross | |

* cited by examiner

*Primary Examiner*—Kimberly Wood
(74) *Attorney, Agent, or Firm*—Thomas R. Lampe

(57) ABSTRACT

Apparatus for releasable attachment to a tub or spa to hold reading material, beverage containers and other articles. The apparatus includes two tables movable relative to one another and structure enabling the apparatus to be used with tubs or spas of different sizes and shapes.

11 Claims, 3 Drawing Sheets

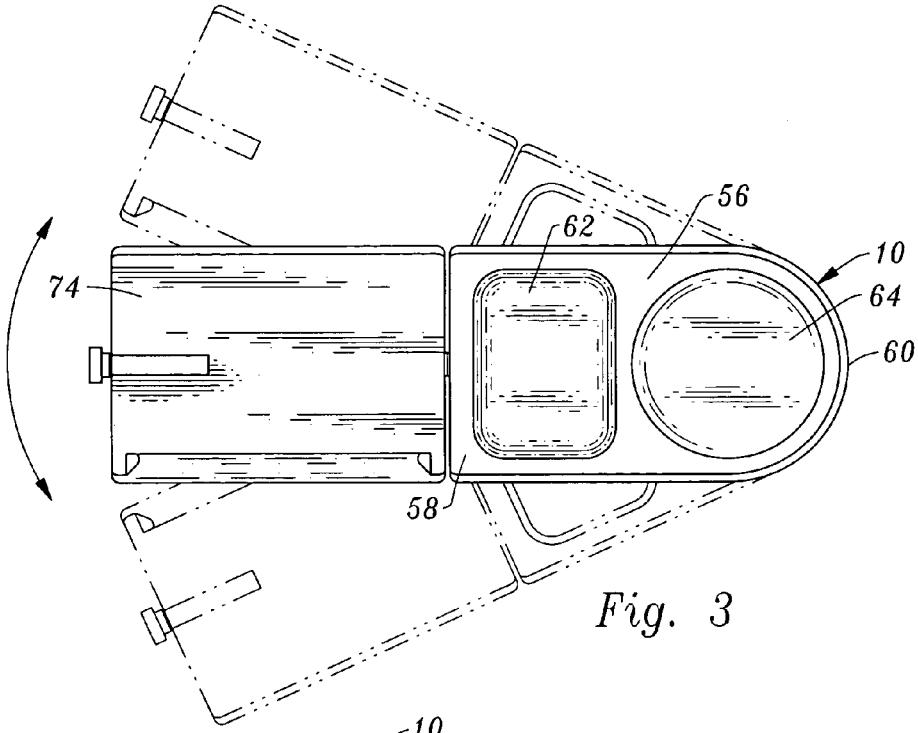
Fig. 3
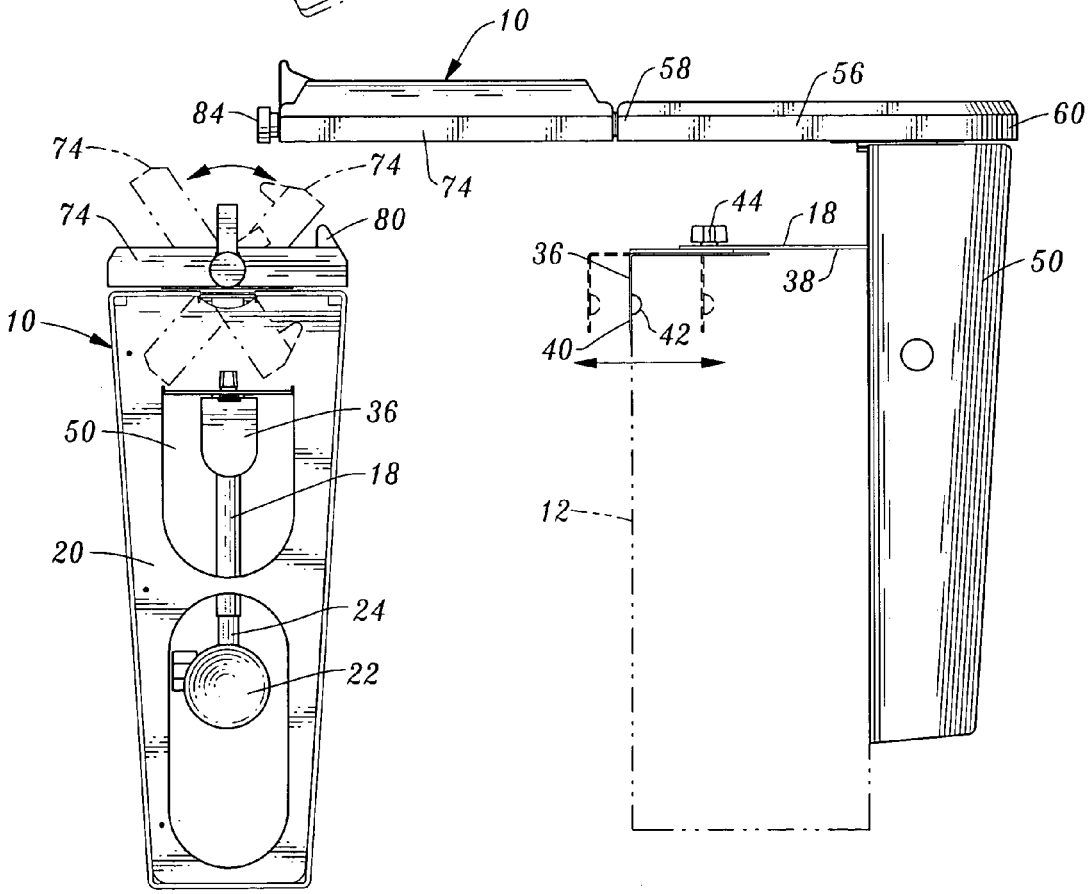
Fig. 5
Fig. 4

APPARATUS FOR HOLDING READING MATERIAL, BEVERAGE CONTAINERS OR OTHER ARTICLES EMPLOYED BY A BATHER

This application is based on and claims the benefit of U.S. Provisional Patent Application No. 60/535,877, filed on Jan. 12, 2004.

TECHNICAL FIELD

This invention relates to apparatus for releasable attachment to a bathing tub or spa for holding and making available to a bather reading material, drinking glasses or other beverage containers or other articles.

BACKGROUND-OF THE INVENTION

The use of caddies, utility trays, holders and the like in association with bathtubs and spas is a well known practice. The following patent publications are exemplary of the current state of the prior art in this field: U.S. Pat. No. 6,474,244, issued Nov. 5, 2002, U.S. Pat. No. 5,761,753, issued Jun. 9, 1998, U.S. Pat. No. 5,621,927, issued Apr. 22, 1997, U.S. Pat. No. 5,707,036, issued Jan. 13, 1998, U.S. Patent Application Publication No. US 2004/0034914, published Feb. 26, 2004, and U.S. Patent Application Publication No. US 2002/0020797, published Feb. 21, 2002.

Many bathers would like to relax in a tub or spa and at the same time read a book, magazine or other reading material. In many instances, the bather also would like to have a cold drink readily available. To read a book, magazine, etc., the bather typically needs to manually hold the reading material while keeping her or his hands out of the water. This is very tiring and impractical in some instances, especially for the elderly. Sometimes candles are used to provide a romantic atmosphere during bathing. One can put drink glasses, ice buckets, candles, etc. on the floor but the bather has to get up to retrieve the item and then must put it back down again. This is highly inconvenient and involves an unnecessary expenditure of energy. Although articles can be placed on some tub or spa rims, they can easily be dislodged.

While caddies and the like are known, they are often inconvenient to use and are inconveniently positioned for the bather. Furthermore, installation and removal of the caddies can be unduly complicated and time consuming. Also, such prior art arrangements can be rather bulky and inconvenient to use or store. Many prior art caddy arrangements do not readily lend themselves to use with different sizes and shapes of tubs and spas.

DISCLOSURE OF THE INVENTION

The apparatus of the present invention is characterized by its relative simplicity, ease of use and versatility. The apparatus can be readily attached to detached from a bathing tub or spa. In addition, the apparatus can be manipulated to either place the reading material, beverage container or the like over the tub or spa interior or move it to a position where it is completely out of the way and will not interfere with the bather. The apparatus has structural features enabling it to be used with different sizes and shapes of tubs and spas.

The apparatus of the invention is for releasable attachment to a bathing tub or spa having a side, an upper rim adjoining the side and an interior defined by an interior wall surface for occupation by a bather. The apparatus is utilized to support a book, magazine or other reading material to be read by the bather as well as to support beverage containers or other articles for ready access by the bather.

The apparatus includes attachment structure for releasable attachment of the apparatus to the side of the tub or spa.

The apparatus includes a first table having a first table distal end and a first table proximal end. The first table is pivotally connected for rotation about a substantially vertical axis to the attachment structure at the first table proximal end and the first table extends outwardly from the attachment structure.

The first table is movable about the substantially vertical axis in a substantially horizontal plane during rotational movement thereof relative to the attachment structure. The first table has an upper surface for supporting a drink container or other articles.

The apparatus also includes a second table having a second table proximal end adjacent to the first table distal end and a second table distal end. The first and second tables are connected, with the second table extending outwardly from the first table distal end and rotatably movable with the first table about the substantially vertical axis.

The second table is pivotally movable relative to the first table about a substantially horizontal axis. The second table has an upper surface for supporting a book, magazine or other reading material.

Other features, advantages and objects of the present invention will become apparent with reference to the following description and accompanying drawings.

BRIEF DESCRIPTION OF DRAWINGS

FIG. 3 is a top, plan view of the apparatus with alternative positions of components thereof shown in solid and dash lines;

FIG. 4 is a side, elevational view of the apparatus and indicating adjustment of a bracket employed therein;

FIG. 5 is an end, elevational view of the apparatus showing some alternative positions assumable by the second table of the apparatus;

BEST MODE FOR CARRYING OUT THE INVENTION

Figure 1:
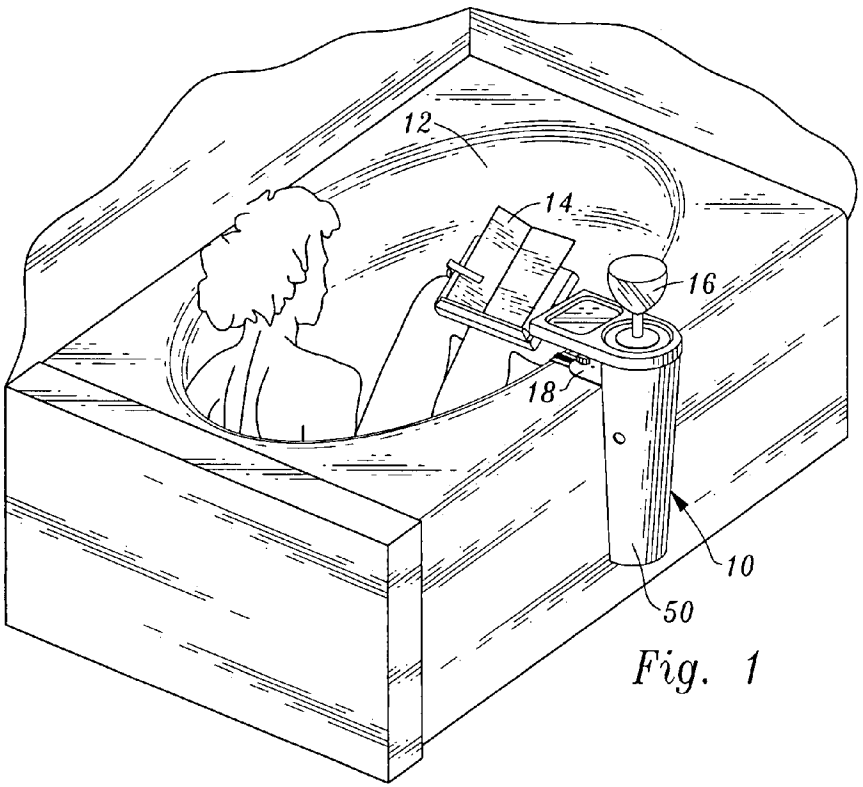
FIG. 1 is a perspective view of a bathing tub occupied by a bather and apparatus constructed in accordance with the teachings of the present invention installed on the tub and presenting a book and non-alcoholic beverage for ready access by the bather.

Referring now to the drawings, apparatus constructed in accordance with the teachings of the present invention is designated by reference numeral 10. FIG. 1 shows apparatus 10 positioned on a bathtub 12 occupied by a bather. The apparatus is holding a book 14 and a non-alcoholic beverage container 16. The tub is conventional and has a side, an upper rim adjoining the side and an interior defined by an interior wall surface occupied by the bather.

The apparatus includes attachment structure 18 for releasably attaching the apparatus to the tub.

The attachment structure includes a primary attachment member 20, a suction cup 22 for engagement with the side of the tub and a suction cup support member 24 connected to and extending upwardly from the suction cup to a portion of the primary attachment member.

Figures 6, 7, 8:
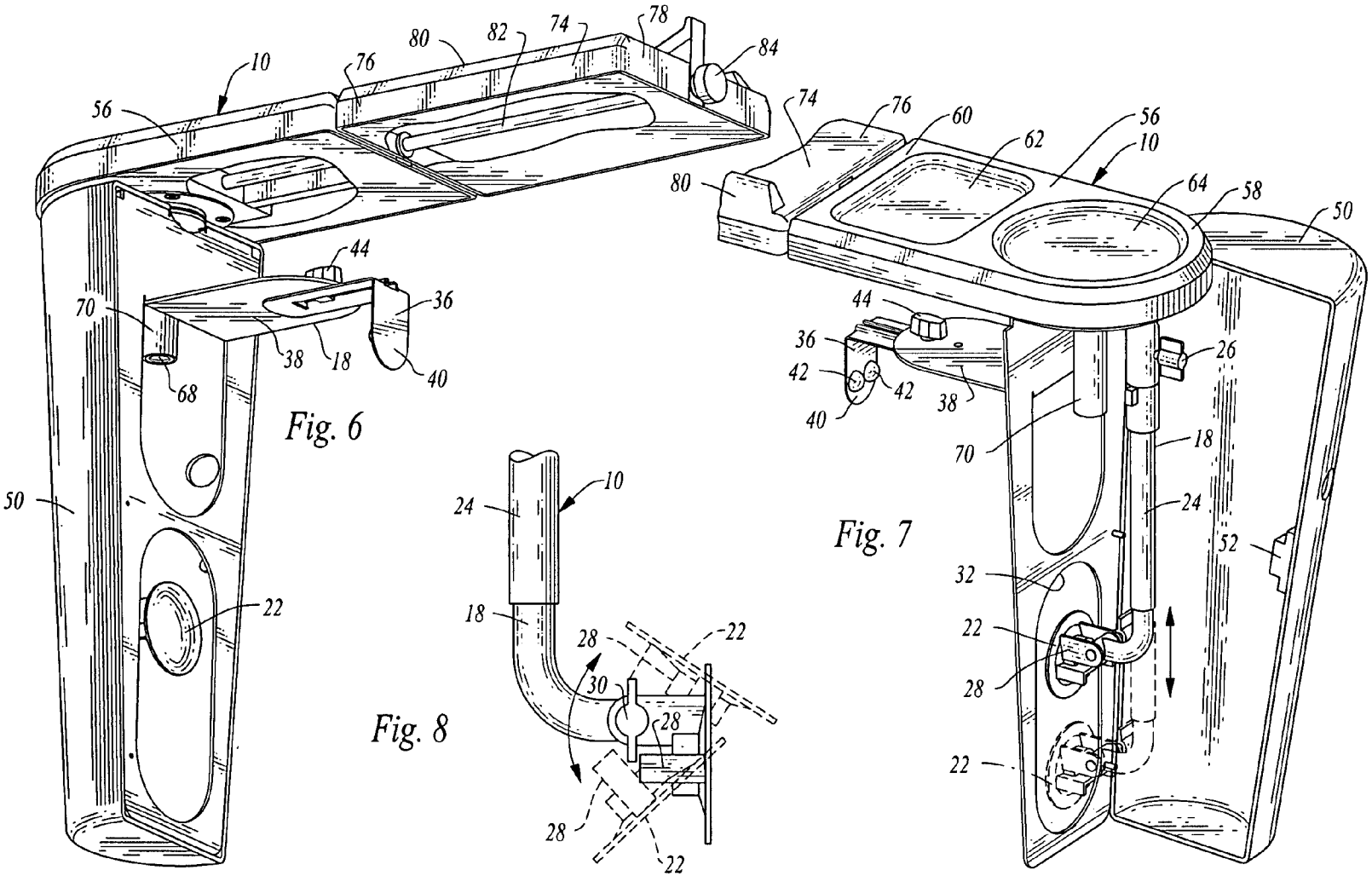
FIG. 6 is a bottom, perspective view of the apparatus, portions of the first and second tables thereof broken away to show internal holder rod structure.
FIG. 7 is a view similar to FIG. 6, but illustrating a cover or housing employed in the invention in open condition and elements of the attachment structure of the apparatus in alternative positions.
FIG. 8 is a side, elevational view of selected components of the invention including elements of the attachment structure shown in alternative positions.

The suction cup support member 24 is of adjustable length, being comprised of two telescopic portions. A lock 26 of any suitable type is employed to selectively alternatively lock the suction cup support member in alternative different lengths. FIG. 7 shows the support member in two alternative representative lengths. This feature is one of many enabling the apparatus to adapt to different sizes and configurations of tubs and spas.

The suction cup 22 is held to the bottom of the support member 24 by a pivoted bracket 28 which may be swiveled as shown in FIG. 8 to position the suction cup at different angular orientations. A lock knob 30 is utilized to lock the suction cup and associated swivel bracket at the desired orientation. The suction cup engages the tub or spa side through an elongated opening 32 formed in the primary attachment member.

The attachment structure additionally includes an adjustable bracket 36 which is elevated relative to the suction cup. The bracket 36 includes a horizontally disposed bracket leg 38 for positioning on the rim of the tub or spa and a downwardly extending bracket leg 40 slidably attached to the horizontally disposed bracket leg for frictionally engaging the interior wall surface of the tub or spa. FIG. 4 shows the downwardly extending bracket leg 40 in three alternative positions enabling the apparatus to be positioned on tubs or spas having different width rims. Cushioning or gripping elements 42 of rubber, plastic or the like are utilized to frictionally engage the interior wall of the tub. A frictional lock having a knob 44 is utilized to lock the bracket 36 in the desired configuration.

Figure 2:
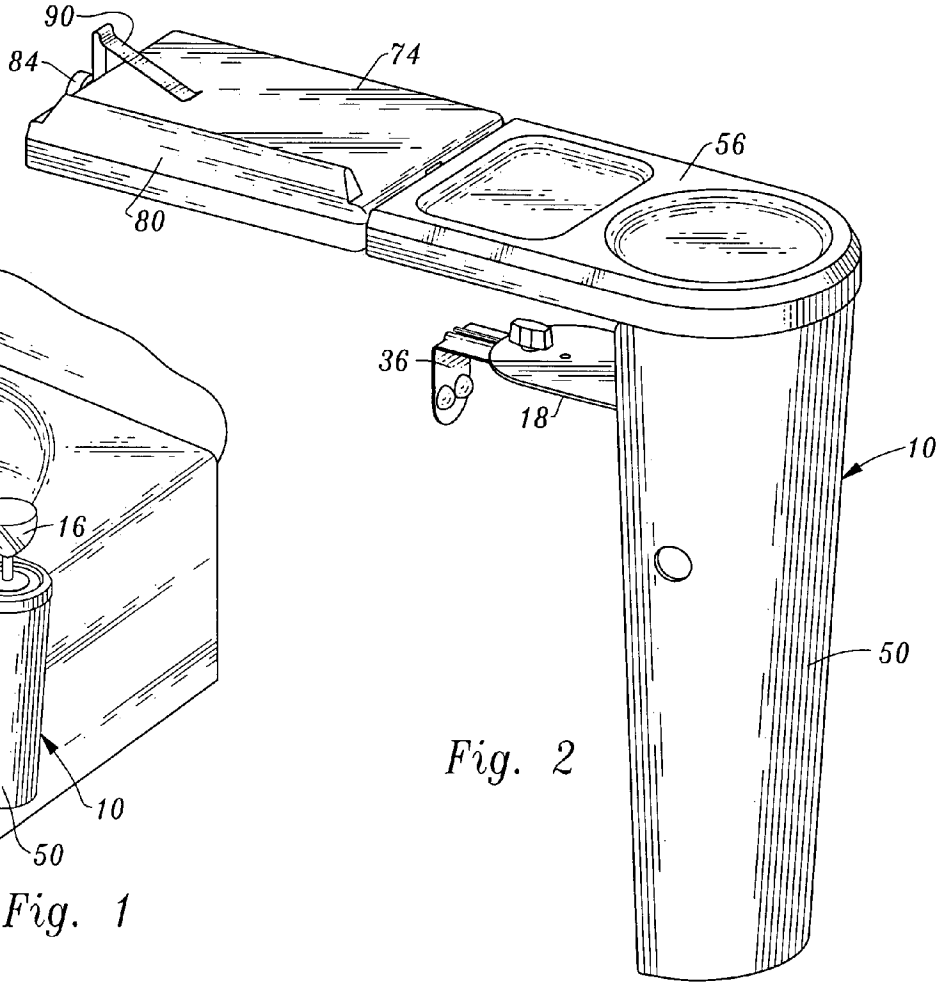
FIG. 2 is a top, perspective view of the apparatus.

The apparatus includes a cover or housing 50 which is pivotally connected to the attachment structure and movable between a closed position (shown in FIG. 2, for example) wherein the suction cup and the suction cup support member are covered thereby and an open position (shown in FIG. 7) wherein the suction cup and the suction cup support member are uncovered for manual access by an individual. A simple magnetic or frictional latch 52 is employed to releasably maintain the cover in closed condition.

The apparatus includes a first table 56 having a first table distal end 58 and a first table proximal end 60. The first table has an upper surface defining indents 62, 64 for supporting a non-alcoholic beverage container or other articles. The first table 56 is pivotally connected for rotation about a vertical axis to the attachment structure 18 at the first table proximal end, with the first table extending outwardly from the attachment structure. The first table is movable about the vertical axis in a horizontal plane during rotational movement thereof relative to the attachment structure.

In particular, a pivot stub shaft 68 extends downwardly from the bottom of the first table 56 and is rotatably accommodated within a support cylinder 70 fixedly attached to attachment structure 18. This allows the first table to be rotatably positioned as shown for example in FIG. 3 whereby the first table can be located close to the bather or removed from the bather. If desired, a lock may be employed to lock the first table against movement at a desired orientation.

The apparatus also includes a second table 74 having a second table proximal end 76 adjacent to the first table distal end and a second table distal end 78. The second table extends outwardly from the first table distal end and the second table is rotatably movable with the first table about the vertical axis of rotation of the first table.

The second table 74 is pivotally movable relative to the first table about a substantially horizontal axis. The second table has an upper surface for supporting a book, magazine or other reading material. A ledge or stop 80 is provided to support the reading material when the second table is tilted. FIG. 5 shows the second table in three different orientations wherein the upper surface thereof is angularly oriented differently relative to the upper surface of the first table.

Referring now to FIG. 6, a rod 82 extends between the first and second tables to provide an interconnection therebetween. The rod has a threaded end (not shown) projecting beyond the second table distal end. The rod is threadedly engaged by a lock knob 84. The other end of the rod 82 is attached to internal structure of the first table. Tightening of the lock knob 84 moves the second table toward the first table and the interconnection between the two is tightened so that frictional forces will prevent rotation of the second table relative to the first table and lock the second table at the desired angular orientation. A retention clip 90 is connected to the second table for frictionally engaging reading material on the upper surface of the second table to resist relative movement therebetween.

The invention claimed is:

1. Apparatus for releasable attachment to a bathing tub or spa having a side, an upper rim adjoining said side and an interior defined by an interior wall surface for occupation by a bather, said apparatus for supporting a book, magazine or other reading material to be read by a bather occupying the interior and for supporting a beverage container or other articles for ready access by the bather occupying the interior, said apparatus comprising, in combination:

attachment structure for releasably attaching the apparatus to the tub or spa;

a first table having a first table distal end and a first table proximal end, said first table pivotally connected at said first table proximal end to said attachment structure for rotation about a substantially vertical axis and extending outwardly from said attachment structure, said first table movable about said substantially vertical axis in a substantially horizontal plane during rotational movement thereof relative to said attachment structure, said first table having an upper surface for supporting a drink container or other articles;

a second table having a second table proximal end adjacent to the first table distal end and a second table distal end, said first and second tables being connected, with said second table extending outwardly from said first table distal end and rotatably movable with said first table about said substantially vertical axis, said second table being pivotally movable relative to said first table about a substantially horizontal axis, said second table having an upper surface for supporting a book, magazine or other reading material; and lock structure for selectively locking said second table against movement relative to said first table whereby said upper surface of said second table may be selectively alternatively locked in a plurality of angular orientations relative to the upper surface of said first table, said first table and said second table being connected by a rod extending therebetween, said rod having a threaded end projecting beyond the second table distal end and said lock structure comprising a lock knob threadedly engaging the threaded end of said rod and frictionally engaging said second table distal end to lock said second table against movement relative to said first table.

2. The apparatus according to claim 1 including a retention clip connected to said second table for frictionally engaging reading material on the upper surface of said second table to resist relative movement therebetween.

3. The apparatus according to claim 1 wherein said first table upper surface defines one or more recess for holding beverage containers or other articles.

4. The apparatus according to claim 1 wherein said attachment structure includes a primary attachment member, a suction cup for engagement with said side and a suction cup support member connected to and extending from said suction cup to said primary attachment member, said suction cup support member being of adjustable length, said attachment structure additionally including a suction cup support member lock for selectively alternatively locking said suction cup support member in alternative different lengths.

5. The apparatus according to claim 4 additionally comprising a cover connected to said attachment structure and movable between a closed position wherein said suction cup and said suction cup support member are covered thereby and an open position wherein said suction cup and said suction cup support member are uncovered for manual access by an individual.

6. The apparatus according to claim 4 wherein said attachment structure additionally includes a bracket attached to said primary attachment member elevated relative to said suction cup.

7. The apparatus according to claim 6 wherein said bracket is adjustable relative to said primary attachment member.

8. The apparatus according to claim 6 wherein said bracket includes a substantially horizontally disposed bracket leg for positioning on the rim and a downwardly extending bracket leg attached to said substantially horizontally disposed bracket leg for frictionally engaging the interior wall surface.

9. The apparatus according to claim 4 wherein said primary attachment member includes a plate defining and opening receiving said vacuum cup.

10. The apparatus according to claim 7 additionally comprising a bracket lock to selectively lock said downwardly extending bracket leg in a plurality of alternative positions relative to said primary attachment member.

11. Apparatus for releasable attachment to a bathing tub or spa having a side, an upper rim adjoining said side and interior defined by an interior wall surface for occupation by a bather, said apparatus for supporting a book, magazine or other reading material to be read by a bather occupying the interior and for supporting a beverage container or other articles for ready access by the bather occupying the interior, said apparatus comprising, in combination:

attachment structure for releasably attaching the apparatus to the tub or spa;

a first table having a first table distal end and a first table proximal end, said first table pivotally connected at said first table proximal end to said attachment structure for rotation about a substantially vertical axis and extending outwardly from said attachment structure, said first table movable about said substantially vertical axis in a substantially horizontal plane during rotational movement thereof relative to said attachment structure, said first table having an upper surface for supporting a drink container or other articles; and a second table having a second table proximal end adjacent to the first table distal end and a second table distal end, said first and second tables being connected, with said second table extending outwardly from said first table distal end and rotatably movable with said first table about said substantially vertical axis, said second table being pivotally movable relative to said first table about a substantially horizontal axis, said second table having an upper surface for supporting a book, magazine or other reading material, said attachment structure including a primary attachment member, a suction cup for engagement with said side and a suction cup support member connected to and extending from said suction cup to said primary attachment member, said suction cup support member being of adjustable length, said attachment structure additionally including a suction cup support member lock for selectively alternatively locking said suction cup support member in alternative different lengths, said primary attachment member including a plate defining an opening receiving said vacuum cup.

* * * * *